US006293035B1

(12) United States Patent
LaPointe

(10) Patent No.: US 6,293,035 B1
(45) Date of Patent: Sep. 25, 2001

(54) SIGN SUPPORTING SYSTEM

(75) Inventor: Jean LaPointe, Laval (CA)

(73) Assignee: Kalitec Signalisation Inc., Laval (CA)

( * ) Notice: Subject to any disclaimer, the term of this patent is extended or adjusted under 35 U.S.C. 154(b) by 0 days.

(21) Appl. No.: 09/292,306

(22) Filed: Apr. 15, 1999

(51) Int. Cl.[7] ..... G09F 15/00

(52) U.S. Cl. ..... 40/607; 40/606; 40/612; 248/230.1; 248/218.4

(58) Field of Search ..... 40/612, 606, 607; 248/218.4, 219.4, 230.1

(56) References Cited

U.S. PATENT DOCUMENTS

| | | | | |
|---|---|---|---|---|
| 210,250 | * | 11/1878 | Greene | 40/607 |
| 1,802,939 | * | 4/1931 | Butler | 40/607 |
| 1,859,578 | | 5/1932 | Baily . | |
| 1,908,360 | | 5/1933 | Hunt . | |
| 1,995,869 | * | 3/1935 | Sprung | 40/607 |
| 2,073,975 | * | 3/1937 | Hammar | 40/607 |
| 3,525,493 | * | 8/1970 | Chrietzberg et al. | 40/606 X |
| 3,623,255 | | 11/1971 | Girard . | |
| 3,950,874 | * | 4/1976 | Diggs | 40/607 |
| 4,040,194 | * | 8/1977 | Penton et al. | 40/607 X |
| 4,548,377 | * | 10/1985 | Huel | 248/219.4 X |
| 4,783,921 | | 11/1988 | George . | |
| 4,864,757 | * | 9/1989 | Lovett | 40/606 X |
| 5,064,157 | * | 11/1991 | O'Neal | 248/230.1 |
| 5,088,672 | * | 2/1992 | Neuendorf et al. | 248/230.1 X |
| 5,335,889 | | 8/1994 | Hopkins et al. . | |
| 5,570,880 | * | 11/1996 | Nordgran | 248/218.4 |
| 5,634,619 | * | 6/1997 | Alessi | 248/230.1 X |

* cited by examiner

*Primary Examiner*—Brian K. Green
*Assistant Examiner*—James M. Hewitt
(74) *Attorney, Agent, or Firm*—Swabey Ogilvy Renault; Michel Sofia

(57) ABSTRACT

A bracket for securing a sign to a post, includes a clamp formed as a flanged open substantially cylindrical body having facing arms adapted to be brought together by a bolt for holding the sign, the tightening of the bolt being both effective for attaching the sign to the bracket and the bracket to the post. The sign defines a slot having an open end for allowing the sign to be inserted between the arms of the body without having to completely unscrew the bolt.

19 Claims, 4 Drawing Sheets

SIGN SUPPORTING SYSTEM

BACKGROUND OF THE INVENTION

1. Field of the Invention

The present invention relates to signs and, more particularly, pertains to structures for holding signs, such as road and street signs.

2. Description of the Prior Art

Over the years, various systems have been developed for securing signs, such as road signs, to a post, a pole or the like. For instance, U.S. Pat. No. 1,802,939 issued on Apr. 28, 1931 to Butler discloses a sign mounting system comprising a split sleeve adapted to be drawn together about an upstanding post by means of a first pair of bolts. Each sleeve section is provided with at least one sign-holder defining a socket within which one end of a sign may be secured by a second pair of bolts. Accordingly, to install a sign, one has to first tighten the first pair of bolts in order to secure the split sleeve to the post and then tighten the second pair of bolts to secure the sign to the sign-holder. Therefore, the installation of the sign necessitates a number of operations which are time consuming.

It has also been proposed, as disclosed in U.S. Pat. No. 4,548,377 issued on Oct. 22, 1985 to Huel, to secure a sign to a post by means of a pair of straps effective for retaining the sign to a bracket as well as fastening the bracket to the. post. However, when it is desired to remove the sign, it is necessary to detach the bracket from the pole, as it is the straps which directly hold the sign in position with respect to the bracket.

Although the sign mounting systems described in the above mentioned patents are effective for attaching a sign to a post, it has been found that there is a need for a sign mounting system which facilitates the installation and removal of a sign from a support structure.

SUMMARY OF THE INVENTION

It is therefore an aim of the present invention to provide an improved sign mounting system which offers ease of assembly and disassembly.

It is also an aim of the present invention to provide such a sign mounting system which is relatively simple and economical to manufacture.

Therefore, in accordance with the present invention, there is provided a system for mounting a sign to a structural member, comprising a clamp adapted to be mounted about the structural member, said clamp including at least a pair of gripping members adapted to cooperate for holding the sign therebetween, and securing means adapted to be engaged with said clamp to retain said gripping members in gripping engagement with the sign, while at the same time securing said clamp to the structural member.

Also in accordance with the present invention, there is provided a combination mounting system and sign for mounting to a structural member, said mounting system comprising a bracket adapted to be mounted about the structural member, said bracket having a pair of gripping members displaceable between an open position for allowing said sign to be inserted therebetween and a closed position for holding said sign, actuator means extending transversely through said gripping members for displacing said gripping members between said open and closed positions thereof, and at least one slot defined in said sign, said slot having an open end to accommodate a portion of said actuator means located between said gripping members, thereby allowing said sign to be installed and removed from said bracket without having to disengage said actuator means from one of said gripping members.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1A:
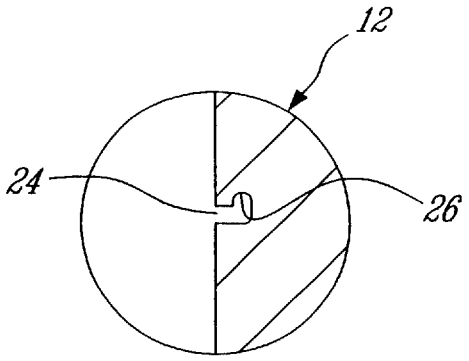
FIG. 1*a* is an enlarged view of a portion of the sign of FIG. 1, showing the details of an open-ended slot thereof.

Now Referring to the drawings, and in particular to FIGS. 1 and 2, a sign mounting system embodying the element of the present invention and generally designated by numeral 10 will be described.

More particularly, the sign mounting system 10 generally comprises a sign 12 held by a clamp or bracket 14 mounted around a vertical post 16.

Figure 2:
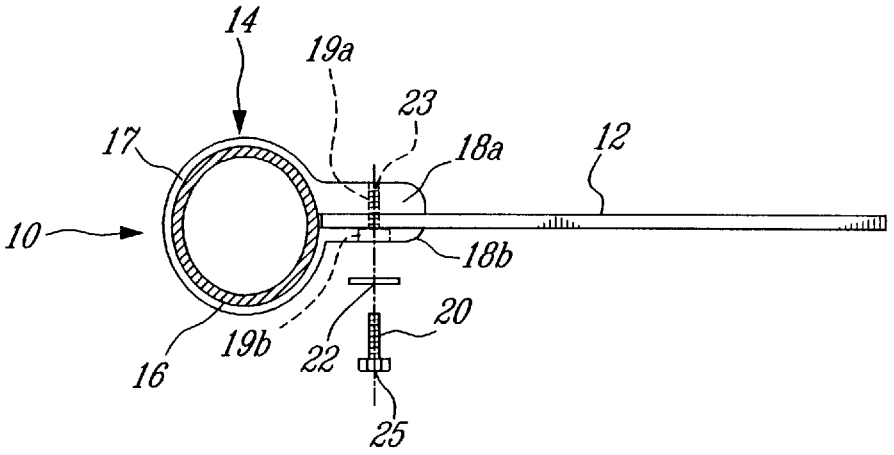
FIG. 2 is a top plan view, partly in cross-section, of the sign mounting system of FIG. 1.

As seen in FIG. 2, the clamp 14 is formed as a partial ring or collar 17 at opposed free ends of which a pair of parallel gripping arms 18*a* and 18*b* extend so as to define a gap therebetween for receiving the sign 12. The gripping arms 18*a* and 18*b* define respective transversal bores 19*a* and 19*b*, which are placed in register for allowing a bolt or actuator means 20 to be driven therein so as to displace the gripping arms 18*a* and 18*b* towards each other while, at the same time, causing the collar 17 to contract around the post 16. A washer 22 may be disposed between the head of the bolt 20 and the gripping arm 18*b*, as is well known in the art.

According to the embodiment illustrated in FIG. 2, the bore 19*a* is provided with internal threads 23 for cooperating with the external threads of the bolt 20, whereas the bore 19*b* is delimited by a smooth surface. However, it is understood that both bores 19*a* and 19*b* could be provided with threads.

The thickness of the gripping arm 18*a* may be greater than that of the gripping arm 18*b* to maximize the length of the bore 19*a* and, thus, allow for the formation of a greater number of internal threads 23, thereby allowing for a wider range of contraction of the clamp 14 through the operation of the bolt 20.

The bolt 20 is provided with a head 25 which is configured to overlie a portion of the surface of the gripping arm 18*b* surrounding the bore 19*b*. Accordingly, continuous advancement of the bolt 20 through the bore 19*a* will urge the undersurface of the head 25 against the gripping arm 18*b*, thereby drawing the gripping arm 18*b* towards the gripping arm 18*a* to a closed position wherein the sign 12 is held tightly captive between the gripping arms 18*a* and 18*b*.

Figure 1:
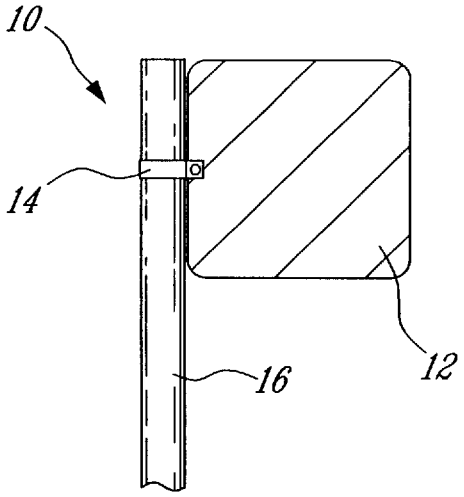
FIG. 1 is an elevational view of a sign mounting system installed on an upstanding post and holding a sign thereon in accordance with a first embodiment of the present invention.

As seen in FIG. 1, the sign 12 defines a L-shaped slot 24 having an open end for allowing the bolt 20 to be engaged within the slot 24 without having to remove the bolt 20 from the bore 19*a*. Therefore, one only has to loosen the bolt 20 such that the gripping arms 18*a* and 18*b* release the sign 12 and allow for the sign 12 to slide therebetween.

To install the sign 12, the collar 17 is first slidably fitted over the upper end of the post 16 down to a selected position. Then, the bolt 20 is tightened so as to draw the gripping arms 18*a* and 18*b* to an intermediate position, wherein the collar 17 is sufficiently collapsed inwardly to ensure that the collar 17 will remain in position on the post 16. Thereafter, the sign 12 is inserted between the gripping arms 18*a* and 18*b* so as to position the portion of the bolt 20 extending between the gripping arms 18*a* and 18*b* in the bottom 26 of the slot 24. Then, the bolt is further tightened to cause the arms 18*a* and 18*b* to tightly clamp onto the sign 12. The inside surfaces of the arms 18*a* and 18*b* each define a ridge which bites into the sign 12 to prevent the latter from coming out.

One advantage of the present invention resides in the fact that when, it is desired to replace the sign 12 with a similar or different sign, one has just to slightly loosen the bolt 20 such that the gripping arms 18*a* and 18*b* allow for the sign 12 to slide therebetween. Indeed, because of the openended slot 24, it is not necessary to completely unscrew the bolt 20 from at least the bore 19*a* to remove the sign 12 from the clamp 14.

According to the embodiment illustrated in FIG. 1, the clamp 14 is of unitary construction and is made of metal.

It is understood that more than one clamp 14 may be provided for supporting a single sign, particularly when the size and the weight of the sign are considerable. In these cases, a number of L-shaped slot 24 corresponding to the required number of clamps 14 would be defined in the sign 12.

Figure 3A:
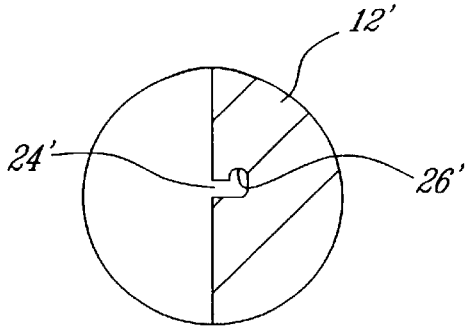
FIG. 3*a* is an enlarged view of a portion of one of the signs of FIG. 3, showing the details of an open-ended slot thereof.
Figure 3:
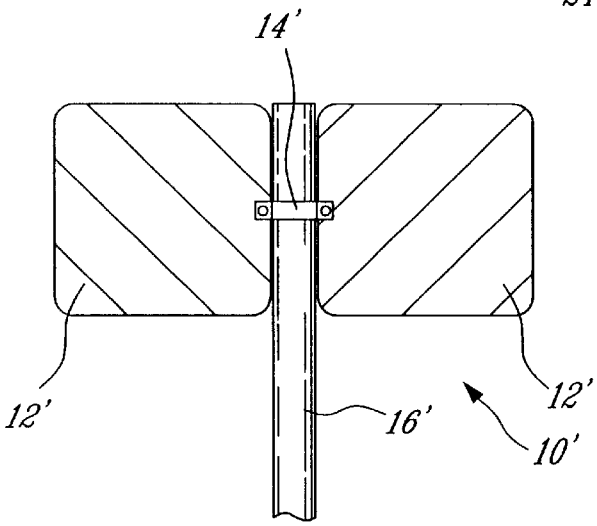
FIG. 3 is an elevational view of a sign mounting system installed on an upstanding post and holding a pair of signs in accordance with a second embodiment of the present invention.
Figure 4:
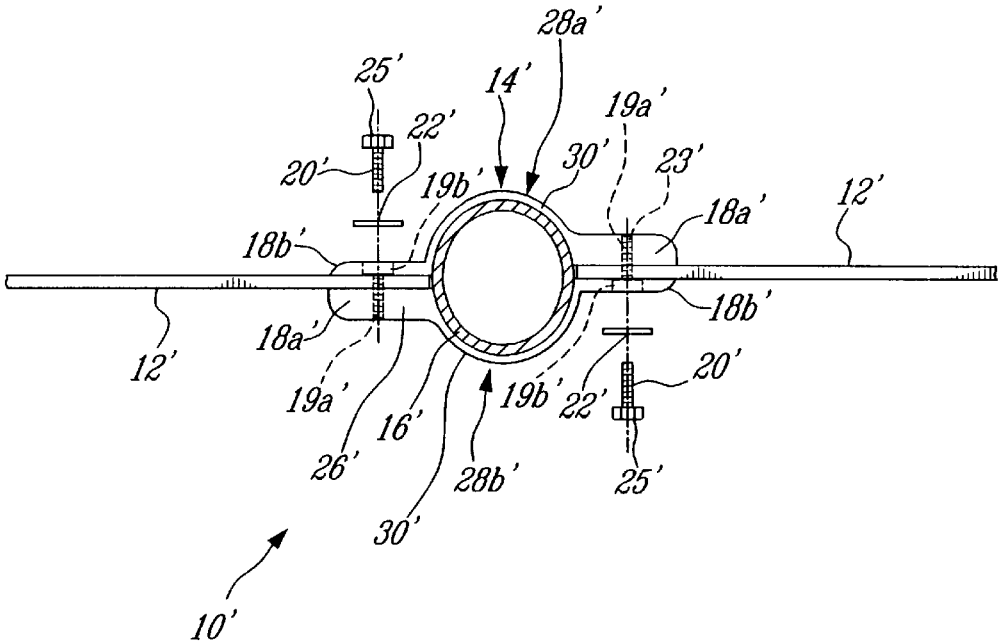
FIG. 4 is a top plan view, partly in cross-section, of the sign mounting system of FIG. 3.

FIGS. 3 and 4 illustrate a second embodiment of the present invention, wherein a clamp 14' is split into two distinct sections 28*a'* and 28*b'*, each of which is composed of a semi-circular central portion 30' from which extend a pair of diametrically opposed gripping arms 18*a'* and 18*b'*.

To draw the sections 28*a* and 28*b* together about a post 16', the gripping arms 18*a'* and 18*b'* of the section 28*a'* are respectively placed in register with the associated gripping arms 18*b*, and 18*a'* of the section 28*b'*, and two bolts 20' are threadably engaged with respective pairs of gripping arms 18*a'* and 18*b'*.

As seen in FIG. 4, this construction of the clamp 14' is intended to support a pair of signs 12' extending in diametrically opposed manner from opposite sides of the post 16'.

The signs 12' are installed and removed as per the way described hereinbefore with respect to the embodiment of FIGS. 1 and 2.

Figure 5:
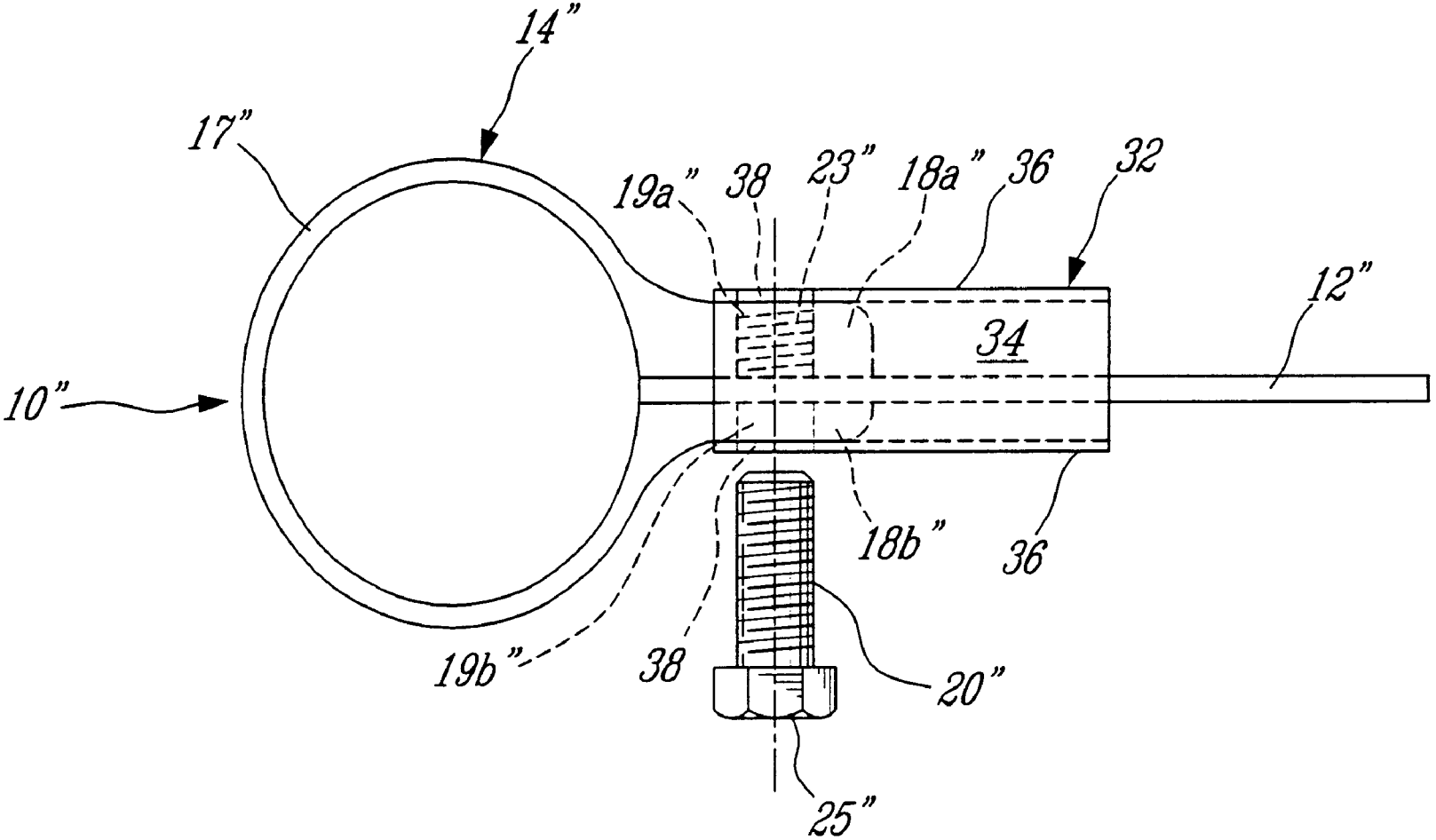
FIG. 5 is a top plan view of a sign mounting system in accordance with a third embodiment of the present invention, wherein an auxiliary gripping member is used to enhance the overall structural rigidity of the sign mounting system.
Figure 6:
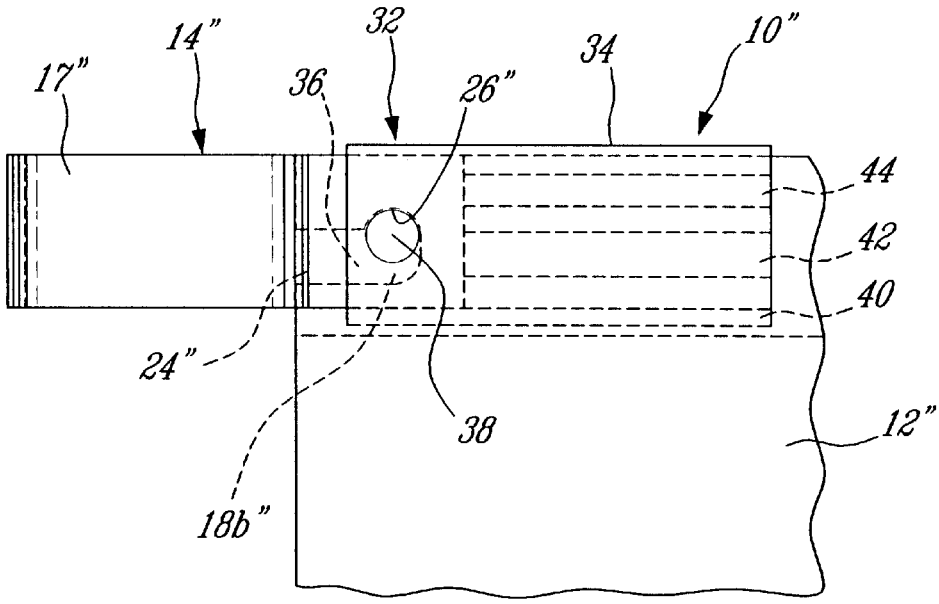
FIG. 6 is a front elevational view of the sign mounting system of FIG. 5.
Figure 7:
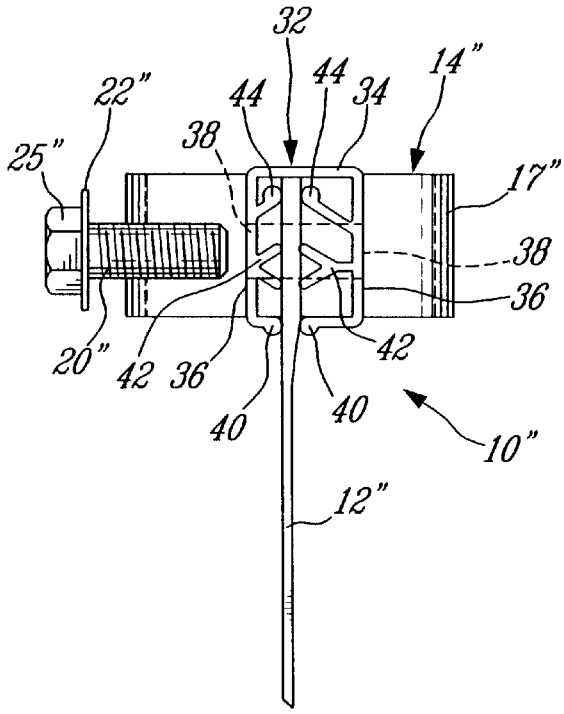
FIG. 7 is a side elevational view of the sign mounting system of FIG. 5.

FIGS. 5 to 7 illustrate a third embodiment of the present invention, wherein an auxiliary gripping member 32, having an inverted U-shaped configuration, is slidably fitted on gripping arms 18*a"* and 18*b"* so as to partly extend beyond a free end portion thereof. The auxiliary gripping member 32 comprises a top wall 34 on opposed sides of which a pair of downwardly extending side walls 36 depend. A pair of registered bores 38 are defined in the side walls 36 to form a transversal passage for a bolt 20". As seen in FIGS. 5 and 6, the bores 38 are aligned with the bores 19*a"* and 19*b"* defined in the gripping arms 18*a"* and 18*b"* and with the bottom, or closed, portion of slot 24" for allowing the passage of the bolt 20" through the gripping arms 18*a"* and 18*b"*.

As seen in FIGS. 6 and 7, a pair of opposed aligned bulbous projections 40 extend inwardly from the bottom edges of respective side walls 36 for frictionally engaging the sign 12". A pair of opposed Y-shaped projections 42 and a pair of opposed inclined bulbous projections 44 extend inwardly from the portion of the side walls 36 extending beyond the free end portions of the gripping arms 18*a"* and 18*b"* to further frictionally retain the sign 12" and, thus, increase the rigidity of the connection between the sign 12" and the clamp 14".

It is noted that the auxiliary gripping member 32 may be installed on the sign 12" prior to being mounted to the gripping arms 18*a"* and 18*b"* or after having been secured thereto by means of the bolt 20.

The third embodiment also differs from the first and second embodiments in that the region of the sign 12" to be engaged by the gripping arms 18*a*and 18*b* is thicker than the remaining portion of the sign 12" to provide increased rigidity.

The signs 12, 12' and 12" and the auxiliary gripping member may be formed by extrusion. The signs 12, 12' and 12" may be formed of polycarbonate.

Although the present invention has been described in connection with a vertical post 16/16", it is understood that the sign mounting systems 10, 10' and 10" may be used with other structural or support members forming part of a given display arrangement.

What is claimed is:

1. A sign assembly for mounting to a structural member, the sign assembly comprising a sign, a clamp adapted to be mounted about the structural member, said clamp including at least a pair of gripping members adapted to cooperate for holding said sign therebetween, and securing means adapted to be engaged with said clamp to retain said gripping members in gripping engagement with said sign, wherein said securing means extend transversely through said gripping members and said sign, and wherein at least one slot having an open end is defined in said sign for allowing said sign to be inserted and removed from between said gripping members without having to disengage said securing means from said clamp.

2. The assembly as defined in claim 1, wherein said securing means are effective for displacing said gripping members between an open position for receiving said sign therebetween and a closed position for holding said sign, while respectively causing said clamp to relax and contract about the structural member.

3. The assembly as defined in claim 2, wherein said securing means include at least one fastener threadably engaged with at least one of said gripping members.

4. The assembly as defined in claim 2, wherein said at least one slot has an L-shaped configuration.

5. The assembly as defined in claim 3, wherein said clamp is formed as a partial loop having opposed free ends, and wherein said gripping members are parallel and extend away from respective ones of said free ends so as to define a gap therebetween.

6. The assembly as defined in claim 5, wherein said clamp is of unitary construction.

7. The assembly as defined in claim 2, wherein said clamp includes two sections adapted to be brought together about the structural member by said securing means, and wherein a pair of arms extend from one section for cooperating with corresponding arms of the other section so as to form two pairs of gripping members.

8. The assembly as defined in claim 2, further comprising an auxiliary gripping member adapted to be mounted on said gripping members so as to extend beyond a free end portion of said gripping members, said auxiliary gripping member being provided with inwardly projecting gripping fingers adapted to hold said sign tightly, thereby providing increased rigidity.

9. The assembly as defined in claim 8, wherein said gripping members have registering holes for receiving said securing means, and wherein said auxiliary gripping member defines a transversal passage adapted to be placed in register with said registering holes of said gripping members for receiving said securing means therethrough.

10. A combination mounting system and sign for mounting to a structural member, said mounting system comprising a bracket adapted to be mounted about the structural member, said bracket having a pair of gripping members displaceable between an open position for allowing said sign to be inserted therebetween and a closed position for holding said sign, actuator means extending transversely through said gripping members for displacing said gripping members between said open and closed positions thereof, and at least one slot defined in said sign, said slot having an open end to accommodate a portion of said actuator means located between said gripping members, thereby allowing said sign to be installed and removed from said bracket without having to disengage said actuator means from one of said gripping members.

11. A combination as defined in claim 10, wherein said actuator means include at least one fastener threadably engaged with at least one of said gripping members.

12. A combination as defined in claim 10, wherein said slot has a L-shaped configuration.

13. A combination as defined in claim 10, wherein said sign has a width which is greater in an area of said sign to be engaged between said gripping members.

14. A combination as defined in claim 10, wherein said bracket is formed as a clamp, and wherein said actuator means is operable for securing said sign to the clamp and the clamp to the structural member at the same time.

15. A combination as defined in claim 14, wherein said clamp is formed as a partial loop having opposed free ends, and wherein said gripping members are parallel and extend away from respective ones of said free ends so as to define a gap therebetween.

16. A combination as defined in claim 14, wherein said clamp includes two sections adapted to be brought together about the structural member by said actuator means, and wherein a pair of arms extend from one section for cooperating with corresponding arms of the other section so as to form two pairs of gripping members.

17. A combination as defined in claim 10, further comprising an auxiliary gripping member adapted to be mounted on said gripping members so as to extend beyond a free end portion of said gripping members, said auxiliary gripping member being provided with inwardly projecting gripping fingers adapted to hold said sign tightly, thereby providing increased rigidity.

18. A system for mounting a sign to a structural member, comprising a bracket adapted to be mounted to the structural member, said bracket including at least a pair of gripping members adapted to cooperate for holding a sign therebetween, and securing means for retaining said gripping members adapted to cooperate for holding a sign engagement with the sign, and an auxiliary gripping member removably fitted over said gripping members so as to extend beyond a free end portion of said gripping members and adapted to frictionally engage both said sign and said bracket, said auxiliary gripping member being provided with inwardly projecting gripping fingers adapted to hold the sign tightly, thereby providing increased rigidity.

19. A system as defined in claim 18, wherein said gripping members have registering holes for receiving said securing means, and wherein said auxiliary gripping member defines a transversal passage adapted to be placed in register with said registering holes of said gripping members for receiving said securing means therethrough.

* * * * *